US010144118B2

(12) United States Patent
Chang

(10) Patent No.: US 10,144,118 B2
(45) Date of Patent: Dec. 4, 2018

(54) DRIVING PORTION OF WRENCH

(71) Applicant: Jason Chang, Taichung (TW)

(72) Inventor: Jason Chang, Taichung (TW)

( * ) Notice: Subject to any disclaimer, the term of this patent is extended or adjusted under 35 U.S.C. 154(b) by 244 days.

(21) Appl. No.: 15/361,016

(22) Filed: Nov. 24, 2016

(65) Prior Publication Data

US 2018/0141192 A1 May 24, 2018

(51) Int. Cl.

| | |
|---|---|
| ***B25B 23/10*** | (2006.01) |
| ***B25B 13/46*** | (2006.01) |
| ***B25B 13/50*** | (2006.01) |
| ***B25B 13/04*** | (2006.01) |
| ***B25B 13/06*** | (2006.01) |
| ***B25B 13/08*** | (2006.01) |
| ***B25B 27/18*** | (2006.01) |

(52) U.S. Cl.

CPC ..... *B25B 13/04* (2013.01); *B25B 13/065* (2013.01); *B25B 13/08* (2013.01); *B25B 13/463* (2013.01); *B25B 27/18* (2013.01)

(58) Field of Classification Search

CPC ..... B25B 13/04; B25B 13/065; B25B 13/08; B25B 13/463

USPC ..... 81/119, 121.1, 186

See application file for complete search history.

(56) References Cited

U.S. PATENT DOCUMENTS 1,954,141 A * 4/1934 Miquelon ..... B25B 13/46 81/119
5,092,203 A * 3/1992 Mader ..... B25B 13/08 81/119
6,098,501 A * 8/2000 Sundstrom ..... B25B 13/04 81/119
6,263,769 B1 * 7/2001 Macor ..... B25B 13/08 81/119
6,267,028 B1 * 7/2001 Macor ..... B25B 13/08 81/119
6,354,175 B1 * 3/2002 Dobson ..... B25B 13/04 81/119
7,146,884 B2 * 12/2006 Chaconas ..... B25B 13/08 81/119
7,661,339 B2 * 2/2010 Wu ..... B25B 13/065 81/119
8,056,448 B2 * 11/2011 Chen ..... B25B 13/04 81/121.1
8,534,167 B2 * 9/2013 Liu ..... B25B 13/46 81/179
8,869,660 B2 * 10/2014 Hsieh ..... B25B 13/04 81/119
2006/0117917 A1 * 6/2006 Lin ..... B25B 13/06 81/125
2006/0130618 A1 * 6/2006 Hsieh ..... B25B 13/065 81/121.1
2007/0214915 A1 * 9/2007 Hsieh ..... B25B 13/04 81/121.1

(Continued)

*Primary Examiner* — David B Thomas

(57) ABSTRACT

A wrench includes a body having a mounting hole. Three first driving portions and three second driving portions are formed in the inner periphery of the mounting hole, and the first and second driving portions are located alternatively to each other. Three first recesses and three second recesses are formed in the inner periphery of the mounting hole, and the first and second recesses are located alternatively to each other. Each first recess is connected between the first and second driving portions. The mounting hole is used to mount to an object which is rotated when the wrench is rotated.

8 Claims, 13 Drawing Sheets

(56) References Cited

U.S. PATENT DOCUMENTS

2007/0261519 A1* 11/2007 Cheng ..... B25B 13/04
81/121.1

* cited by examiner

DRIVING PORTION OF WRENCH

BACKGROUND OF THE INVENTION

1. Fields of the Invention

The present invention relates to a hand tool, and more particularly, to a driving portion of a wrench.

2. Descriptions of Related Art

One of the conventional wrenches known to applicant includes a driving portion which is used to rotate a hexagonal object, and includes multiple first teeth and multiple second teeth, the first and second teeth extend toward opposite directions. Nevertheless, when the wrench rotates the object, the first and second teeth are too sharp to apply sufficient torque to the object. USPN 2006/0117917 discloses a socket which includes stop ribs, when the socket is mounted to an object, the stop ribs are engaged with corners of the object. However, the stop ribs each have a tip which cannot bear high torque to loosen an object.

The present invention intends to provide a driving portion of a wrench which rotates clockwise to tighten an object, and counter-clockwise to loosen an object. The three first applying portions do not cause damage to sides of the object. When the object is rounded, the three first applying portions effectively hold the sides of the object to successfully rotate the object.

SUMMARY OF THE INVENTION

The present invention relates to a wrench and comprises a body having a mounting hole. Three first driving portions and three second driving portions are formed in the inner periphery of the mounting hole, and the first and second driving portions are located alternatively to each other. Three first recesses and three second recesses are formed in the inner periphery of the mounting hole, and the first and second recesses are located alternatively to each other. Each first recess is connected between the first and second driving portions. The mounting hole is used to mount to an object which is rotated when the wrench is rotated.

The primary object of the present invention is to provide a wrench having a mounting hole which is shaped to tighten or loosen an object, the object can be a normal object or a rounded object.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
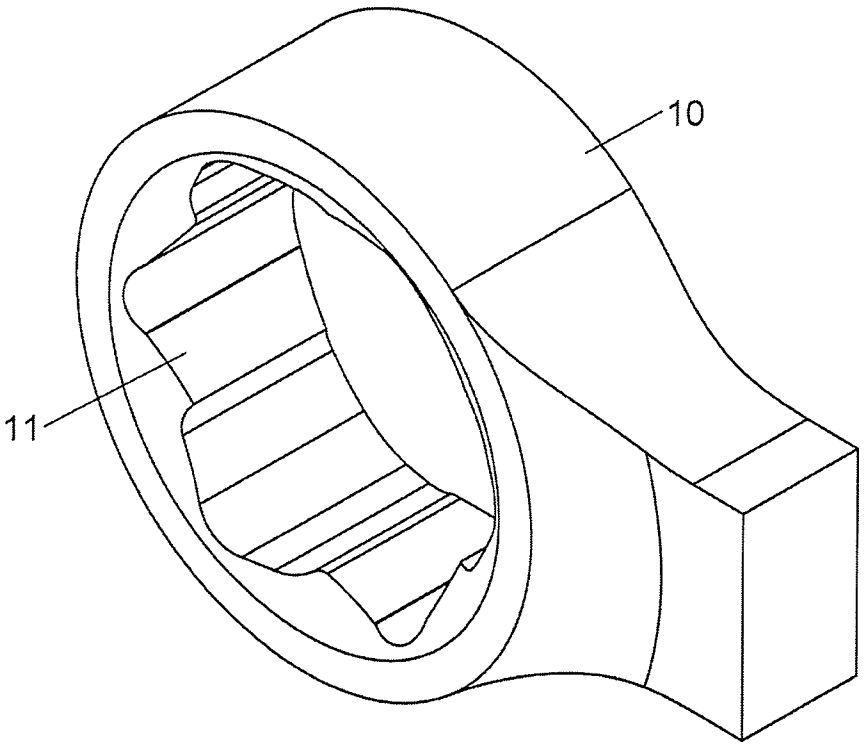
FIG. 1 is a perspective view of the wrench of the present invention.
Figure 3:
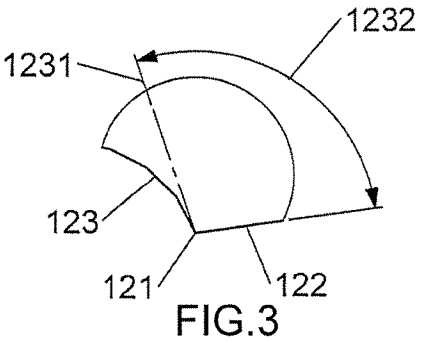
FIG. 3 is an enlarged view of the circled portion "A" in FIG. 2.
Figure 2:
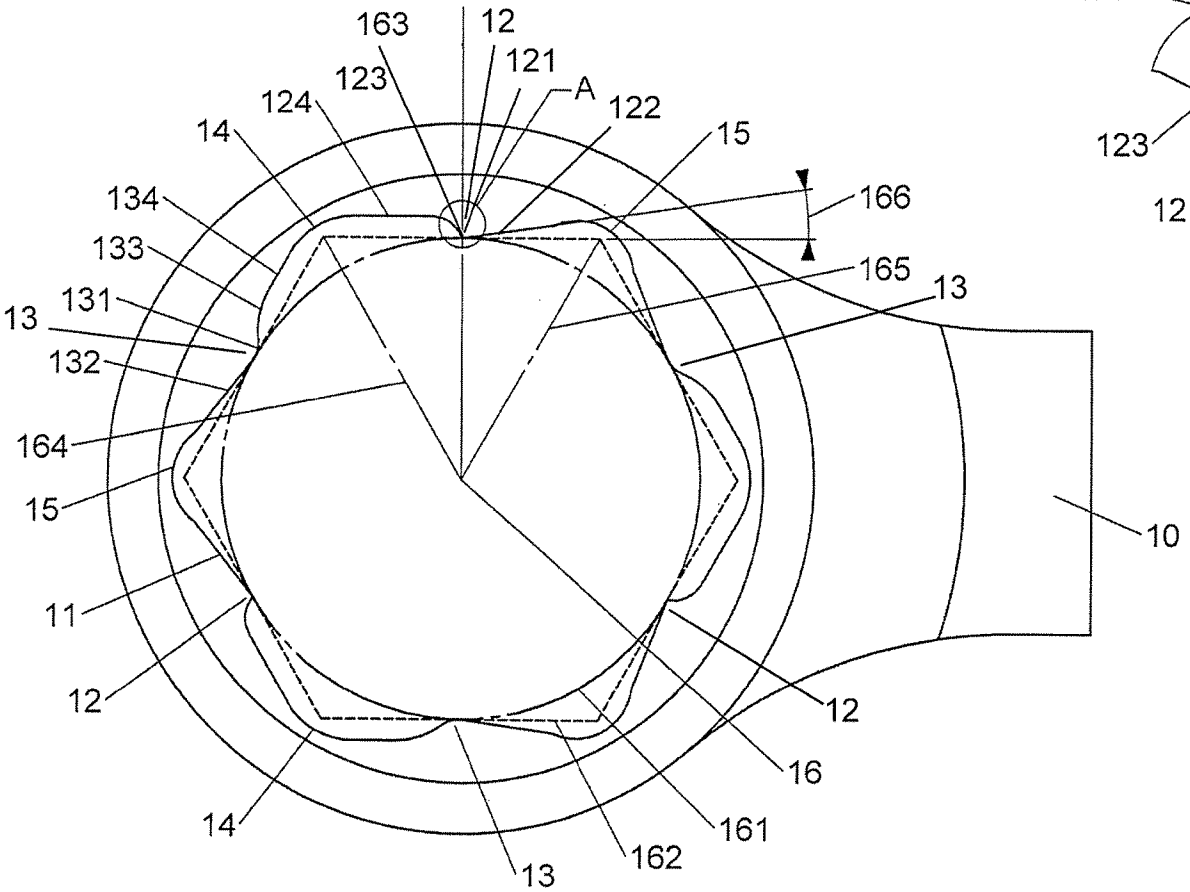
FIG. 2 is a top view of the wrench of the present invention.

Referring to FIGS. 1 to 3, the wrench of the present invention comprises a body 10 which has a mounting hole 11 defined therethrough. The mounting hole 11 has three first driving portions 12 in equal central angle and three second driving portions 13 in equal central angle defined in the inner periphery thereof. The first driving portions 12 are located alternatively relative to the second driving portions 13. Furthermore, three first recesses 14 and three second recesses 15 are defined in the inner periphery of the mounting hole 11. The first recesses 14 are located alternatively relative to the three second recesses 15. Each first recess 14 is connected between one of the first driving portions 12 and one of the second portions 13. The wrench is a box-end wrench.

As shown in FIG. 3, each first driving portion 12 has a first applying portion 121 which is a tip, a first face 122, a first curved face 123 and a second face 124. The first applying portion 121 is located at the middle portion of the first driving portion 12 corresponding thereto. The first applying portion 121 is connected between the first face 122 and the first curved face 123. The first face 122 is a plane or a protruded face. A tangent line 1231 passes through the connection point between one end of the first curved face 123 and the first applying portion 121. An angle 1232 defined between the tangent line 1231 and the plane first face 122 being between 100 degrees to 120 degrees, preferably, the angle 1232 is 100 degrees. The tangent line 1231 is tangent to the first curved face 123. The other end of the first curved face 123 is connected to the second face 124. The second face 124 is tangent and connecting to the first curved face 123. The second face 124 is a plane or a protruded face.

Each second driving portion 13 has a second applying portion 131 which is a tip, a third face 132, a second curved face 133 and a fourth face 134. The second applying portion 131 is located at the middle portion of the second driving portion 13 corresponding thereto. The second applying portion 131 is connected between the third face 132 and the second curved face 133. The third face 132 is a plane or a protruded face. The second curved face 133 is tangent and connecting to the second applying portion 131. One end of the second curved face 133 is connected to the fourth face 134. The fourth face 134 is tangent and connecting to the second curved face 133. The fourth face 134 is a plane or a protruded face.

The first recess 14 is located between the second face 124 and the fourth face 134. The first recess 14 is tangent and connecting to the second face 124 and the fourth face 134.

The second recess 15 is located between the first face 122 and the third face 132, but the second recess 15 is not tangent to the first and third faces 122, 132.

The center of the mounting hole 11 is the center 16 of the circle 161. The circle 161 is externally tangent to a hexagon 162. Each of the first applying portions 121 is located on the middle point 163 of one of six sides of the hexagon 162. The second faces 124 are respectively parallel to three of six sides of the hexagon 162, and the fourth faces 134 are parallel to the other three of the six sides of the hexagon 162. Each of the second applying portions 131 is tangent to one of the six sides of the hexagon 162. The second face 124 and the fourth face 134 are symmetric relative to a diagonal line 164 that passes through two of six corners of the hexagon 162. The first face 122 and the third face 132 being symmetric relative to another diagonal line 165 that passes through two of six corners of the hexagon 162. The center of each of the first recesses 14 is located on the diagonal line 164, and the center of each of the second recesses 15 located on the diagonal line 165. An angle 166 between the first face 122 and the side of the hexagon 162 corresponding to the first face 122 is 6 to 15 degrees. Preferably, the angle 166 is 8 to 10 degrees.

Figure 4:
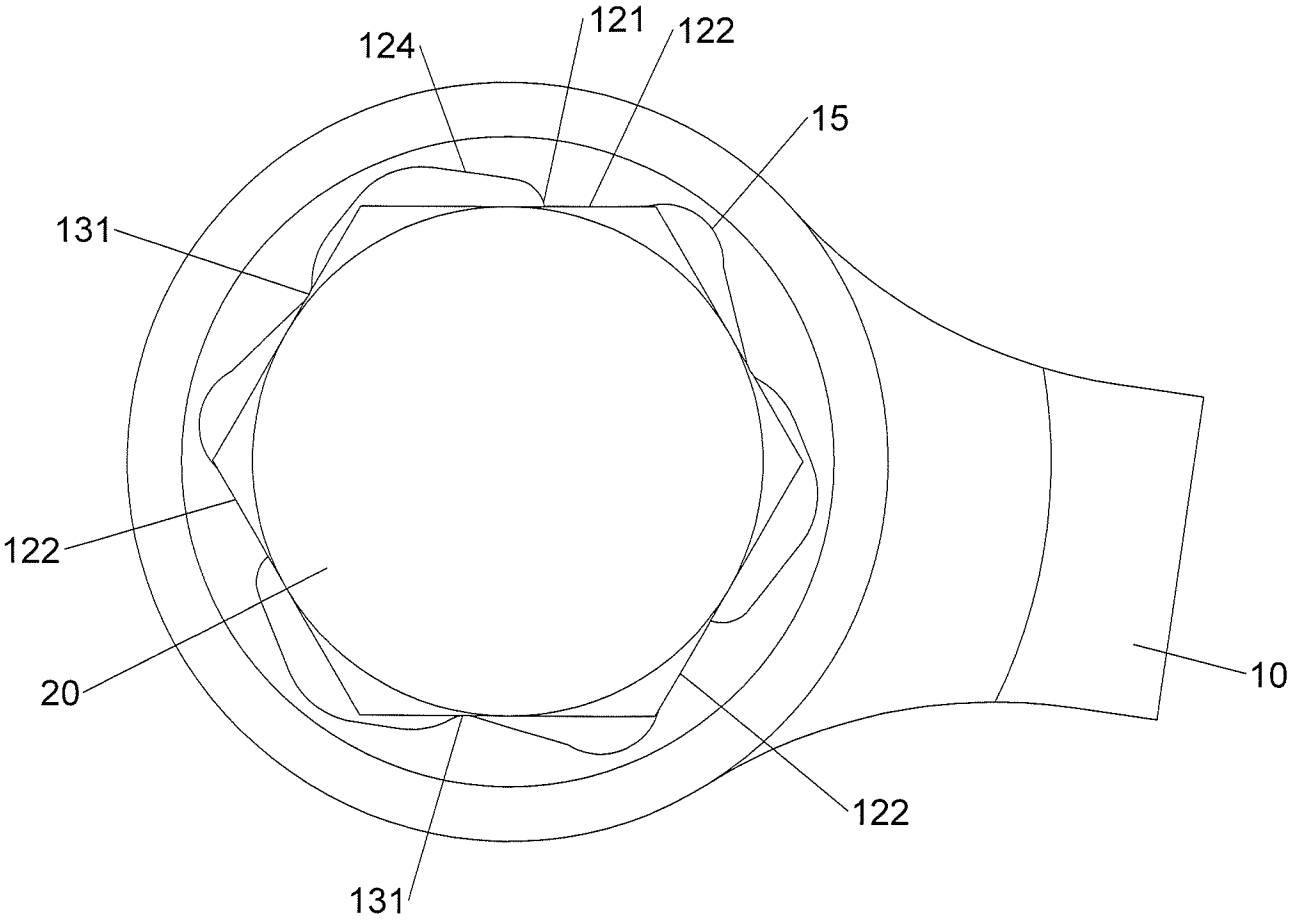
FIG. 4 shows the first operational status of the wrench of the present invention which is mounted to an object.

As shown in FIG. 4, when the body 10 rotates a hexagonal object 20 clockwise, each of the first applying portions 121 and each of the second applying portions 131 contact a respective side of the six sides of the object 20. The three first faces 122 contact the three sides of the object 20, and the three second applying portions 131 contact the other three sides of the object 20. The six corners of the object 20 are respectively located in the first and second recesses 14, 15. The second recesses 15 are not tangent to the first faces 122 so as to prevent from damaging the corners of the object 20. When the body 10 rotates the object 20 clockwise, the three first faces 122 are the primary positions for applying force to the object 20, and the three second applying portions 131 are the secondary positions for applying force to the object 20.

Figure 5:
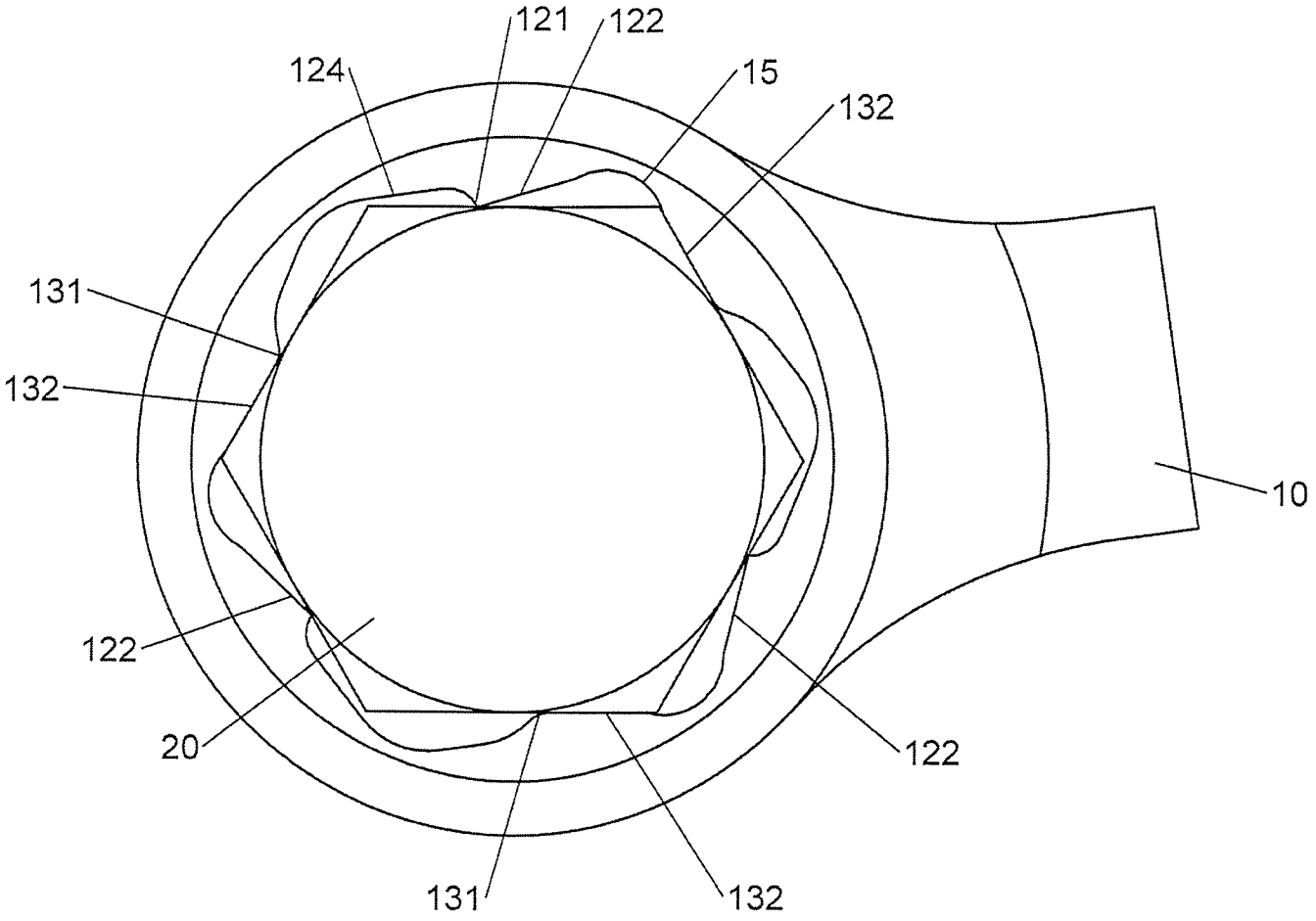
FIG. 5 shows the second operational status of the wrench of the present invention which is mounted to an object.

As shown in FIG. 5, when the body 10 rotates a hexagonal object 20 counter clockwise, each of the first applying portions 12 and each of the second applying portions 13 contact a respective side of the six sides of the object 20. The three first applying portions 121 contact the three sides of the object 20, and the three third faces 132 contact the other three sides of the object 20. The six corners of the object 20 are respectively located in the first and second recesses 14, 15. When the body 10 rotates the object 20 counter clockwise, the three third faces 132 are the primary positions for applying force to the object 20, and the three first applying portions 121 are the secondary positions for applying force to the object 20.

Figure 6:
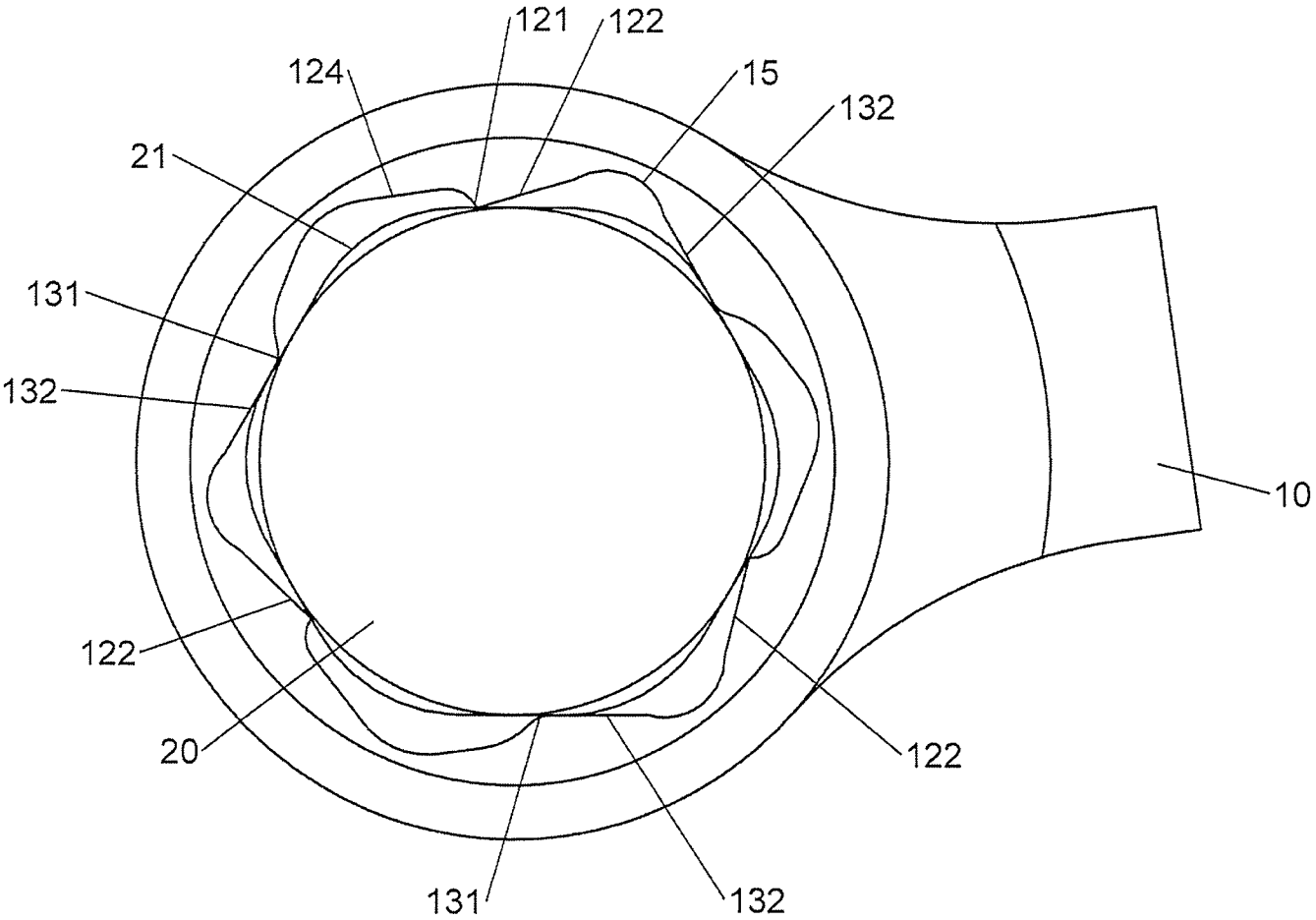
FIG. 6 shows the third operational status of the wrench of the present invention which is mounted to an object.

As shown in FIG. 6, when the object 20 is rounded, and the body 10 rotates the hexagonal object 20 counter clockwise, the three third faces 132 contact the three sides of the object 20 at limited areas. The first applying portion 121 of each first driving portion 12 applies a larger force to the object 20. The three first applying portions 121 "bite" the sides of the object 20 so that the object 20 can be rotated.

Figure 7:
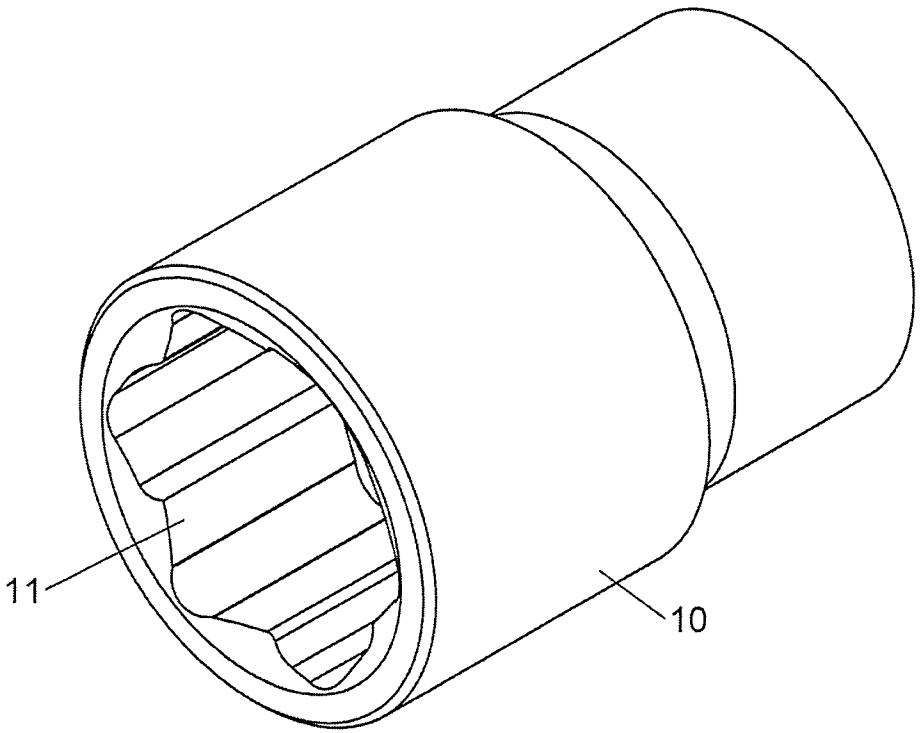
FIG. 7 is a perspective view of the second embodiment of the wrench of the present invention.
Figure 8:
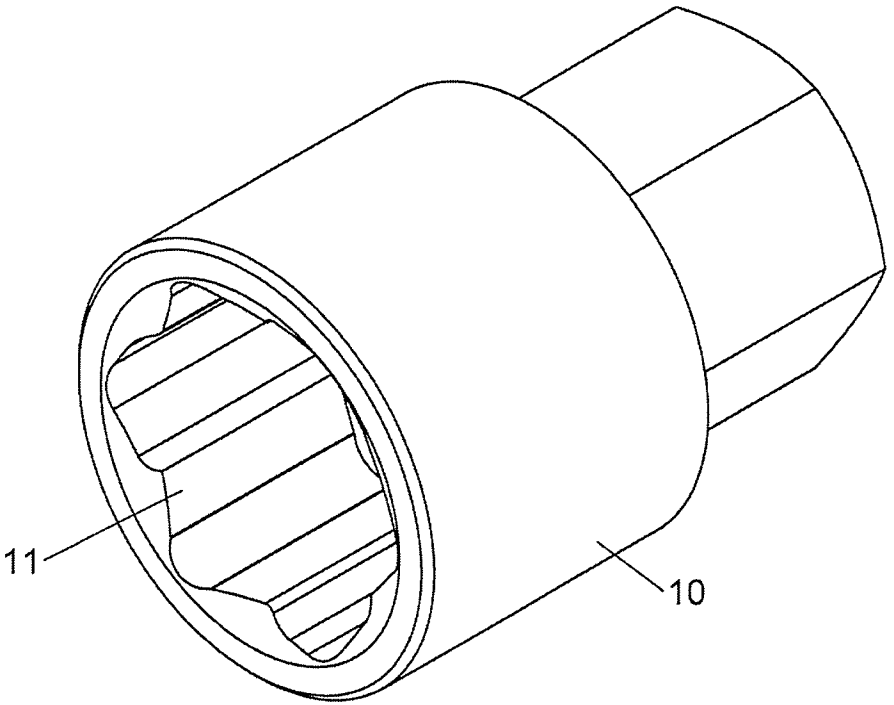
FIG. 8 is a perspective view of the third embodiment of the wrench of the present invention.
Figure 9:
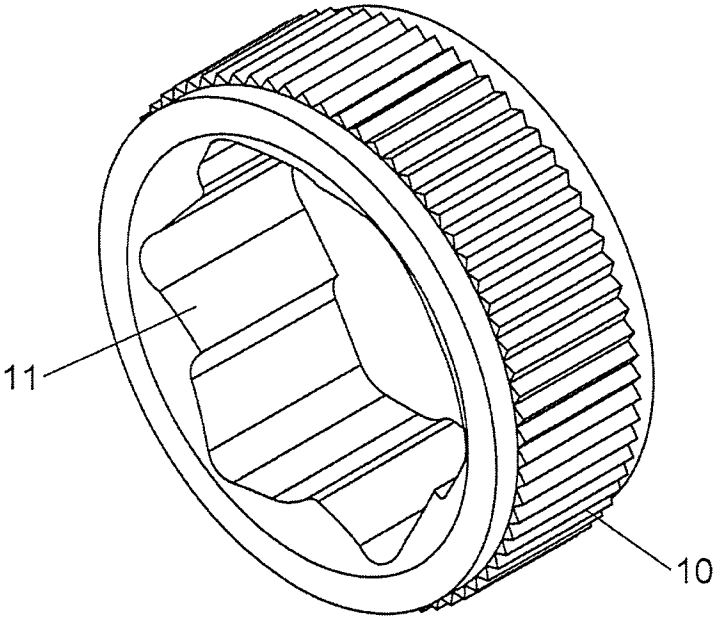
FIG. 9 is a perspective view of the fourth embodiment of the wrench of the present invention.
Figure 11:
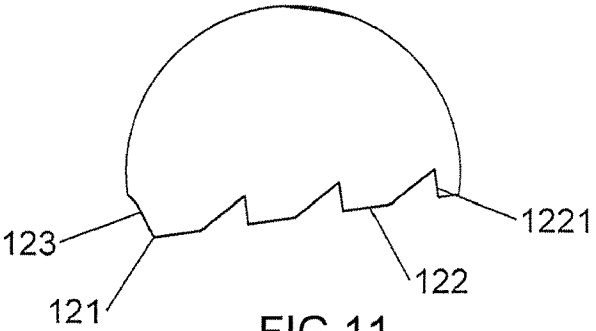
FIG. 11 is an enlarged view of the circled portion "A" in FIG. 10.
Figure 10:
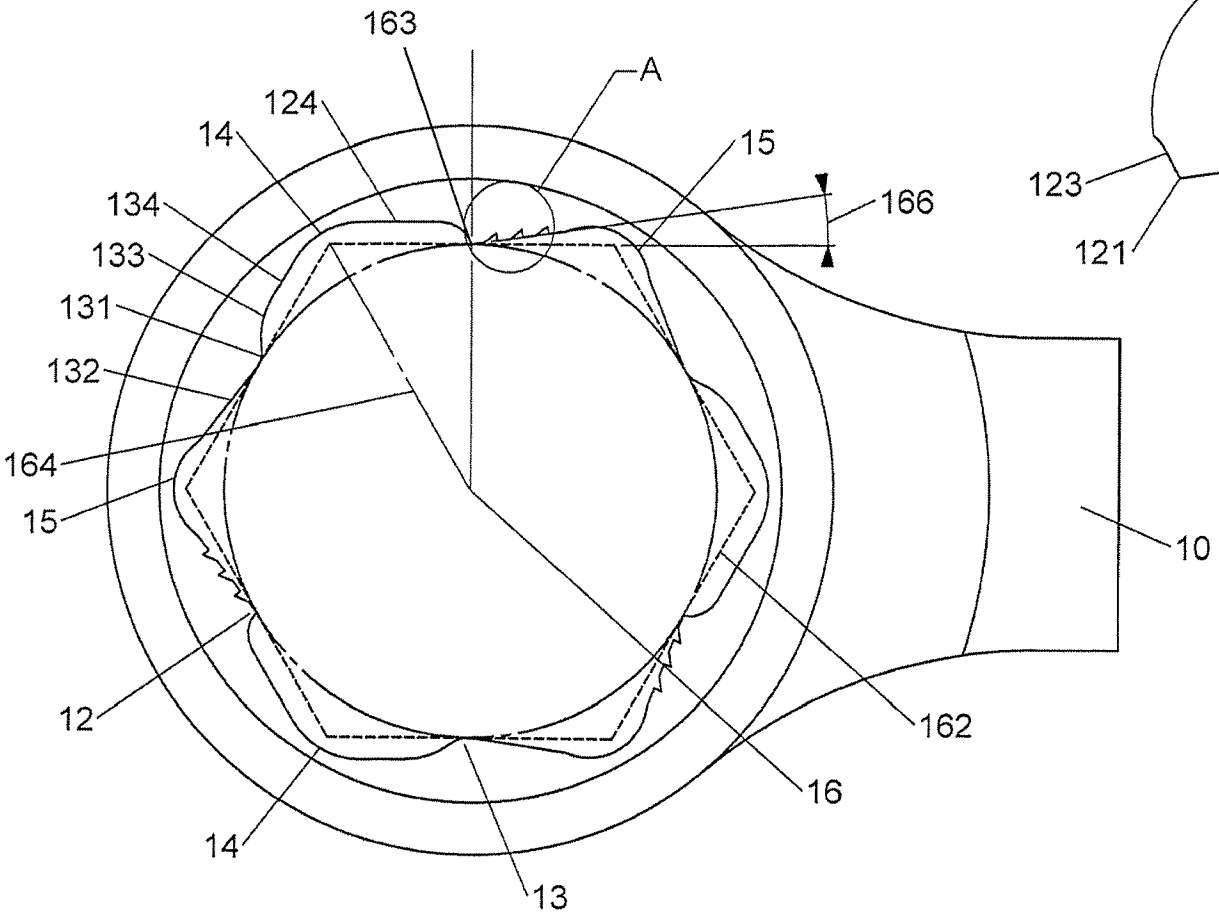
FIG. 10 is a perspective view of the fifth embodiment of the wrench of the present invention.

FIG. 7 shows that the body 10 is a socket. FIG. 8 shows that the body 10 is a socket with a passage defined axially therethrough. FIG. 9 shows that the body 10 is a ratchet wheel which is pivotably connected to a ratchet wrench. As shown in FIGS. 10 and 11, the first face 122 includes multiple notches 1221 which are located along a straight line.

Figure 12:
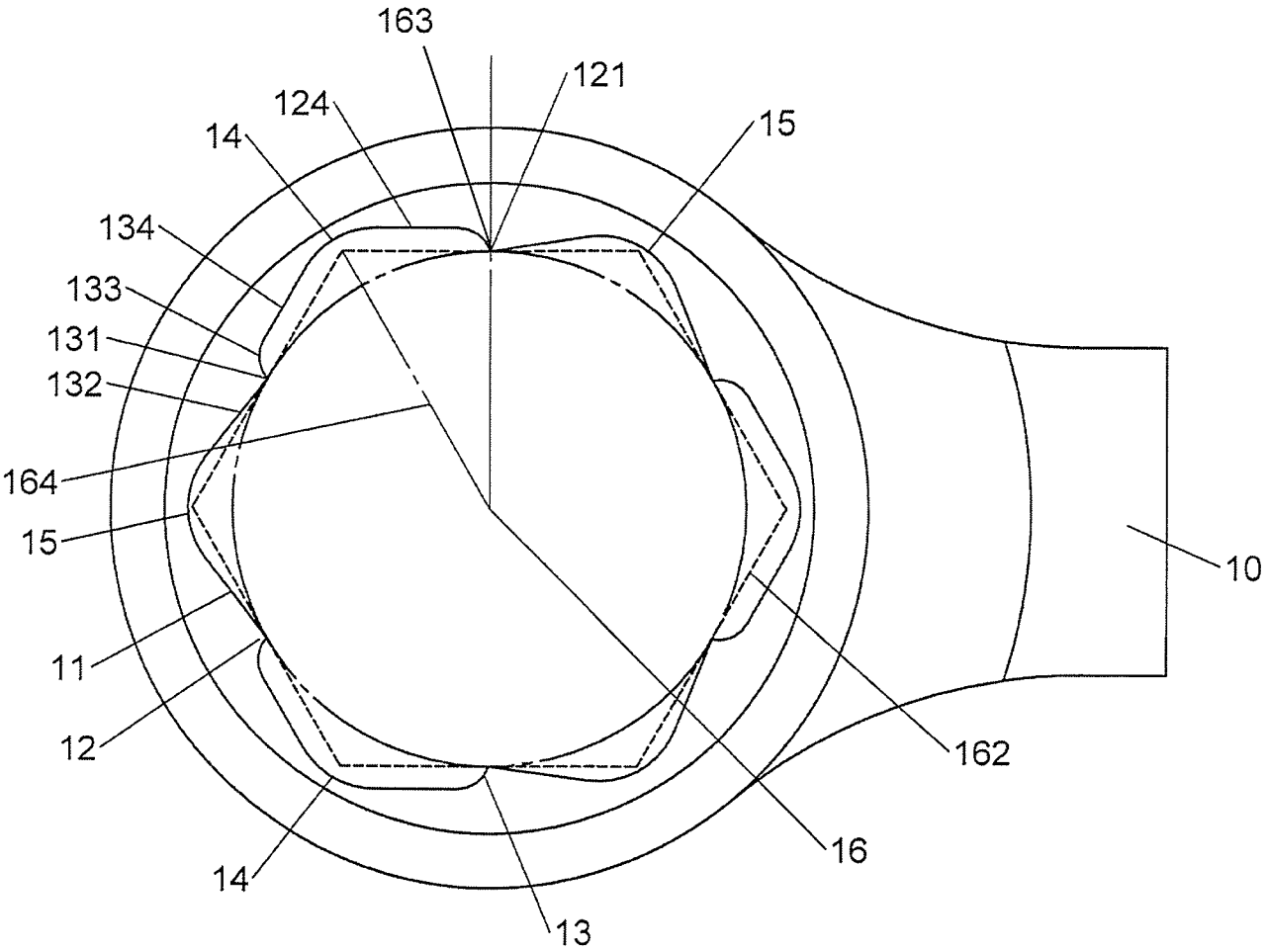
FIG. 12 shows the top view of the sixth embodiment of the wrench of the present invention.

As shown in FIG. 12, the second applying portion 131 of each of the second applying portions 13 is a tip which is identical to the first applying portion 121. The first and second applying portions 121, 131 are symmetric relative to the diagonal line 164. The second recesses 15 each are tangent to the first and third faces 122, 132.

Figure 13:
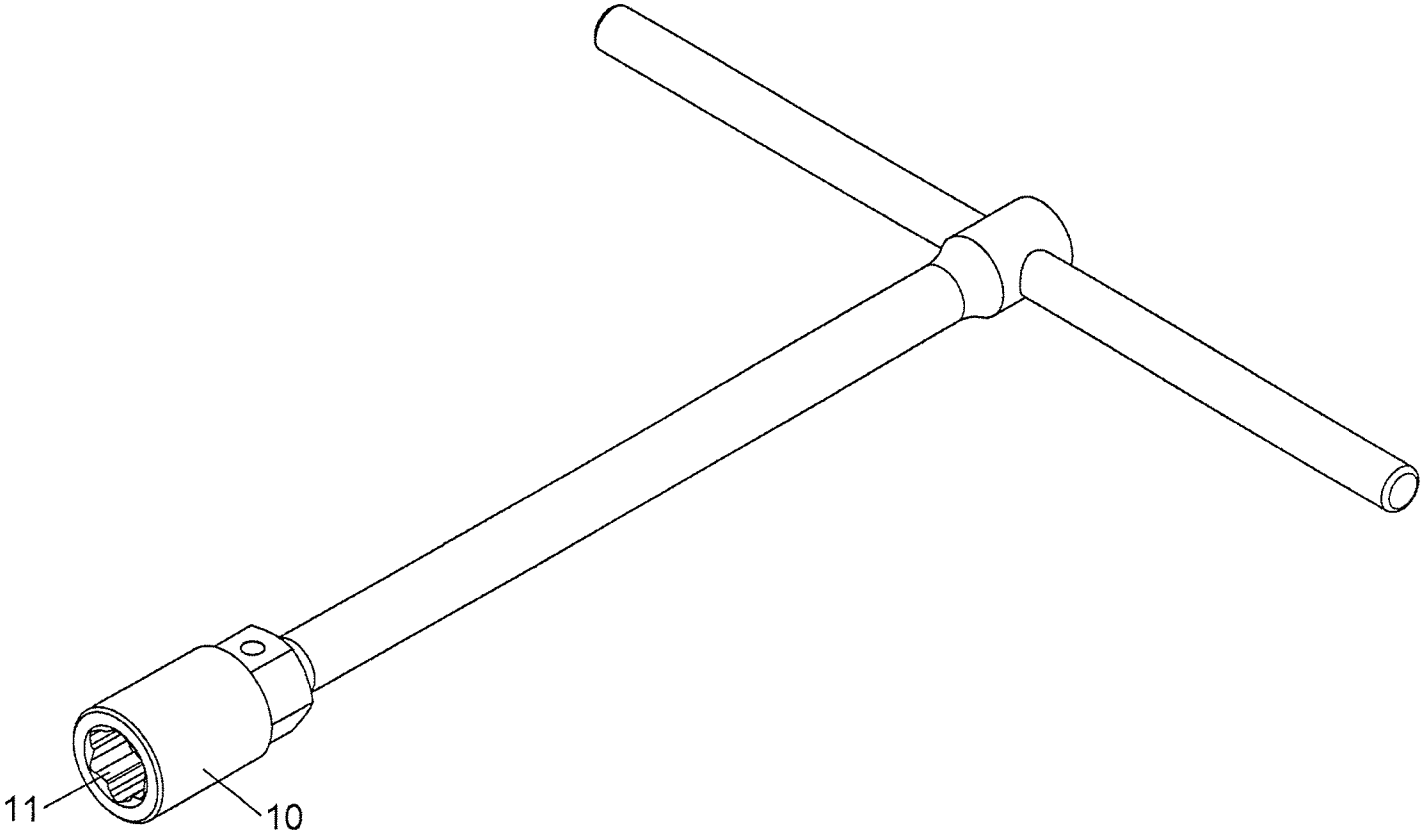
FIG. 13 is a perspective view of the seventh embodiment of the wrench of the present invention.
Figure 14:
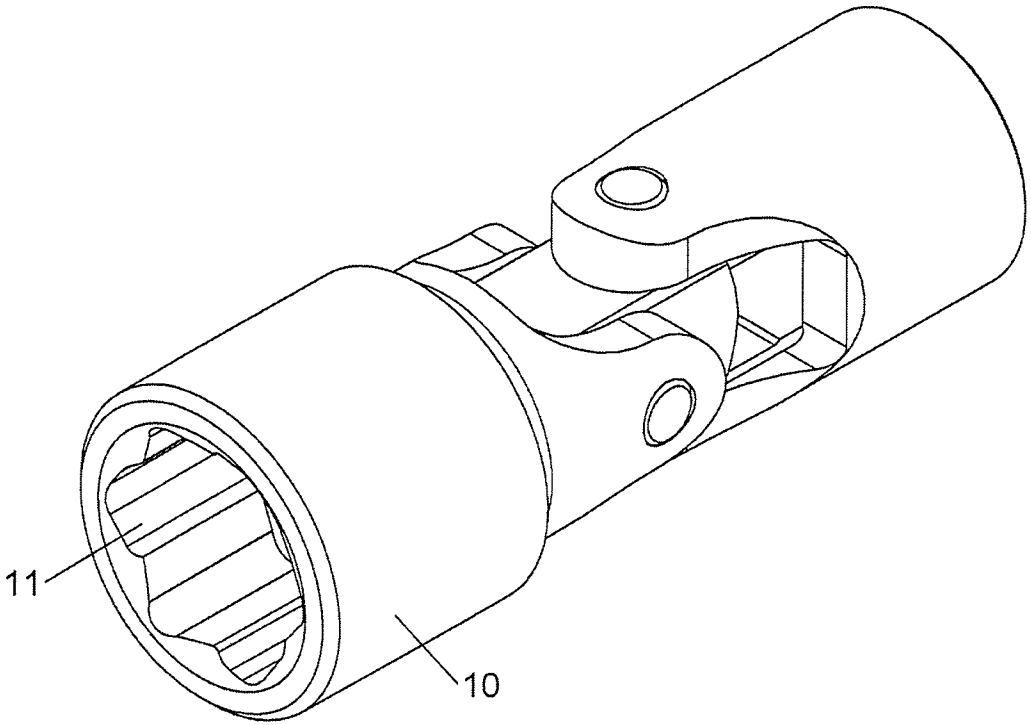
FIG. 14 is a perspective view of the eighth embodiment of the wrench of the present invention.
Figure 15:
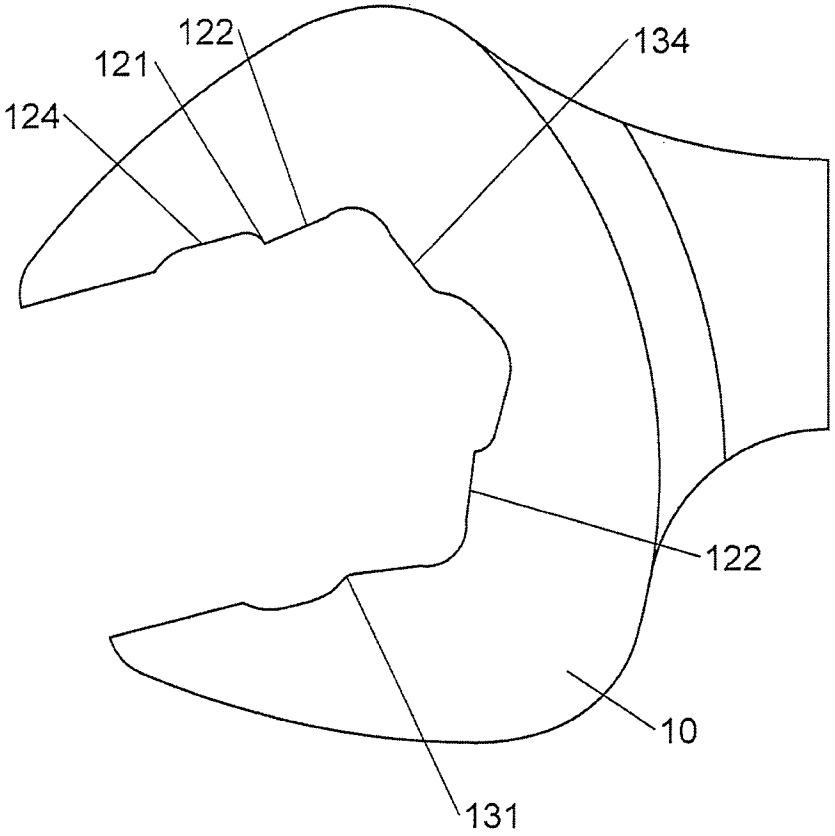
FIG. 15 is a perspective view of the ninth embodiment of the wrench of the present invention.

FIG. 13 shows that the body 10 is a T-bar wrench. FIG. 14 shows that the body 10 is an universal connector and FIG. 15 shows that the body 10 is an open-end wrench.

The advantages of the present invention are that when the body 10 rotates a hexagonal object 20 clockwise, the three first faces 122 are the primary positions for applying force to the object 20, and the three second applying portions 131 are the secondary positions for applying force to the object 20.

When the body 10 rotates the object 20 counter clockwise, the three third faces 132 are the primary positions for applying force to the object 20, and the three first applying portions 121 are the secondary positions for applying force to the object 20. The force applied to the object 20 from the first applying portions 121 are limited so that the sides of the object 20 are not damaged by the first applying portions 121.

when the object 20 is rounded, and the body 10 rotates the hexagonal object 20 counter clockwise, the three third faces 132 contact the three sides of the object 20 at limited areas. The first applying portion 121 of each first driving portion 12 applies a larger force to the object 20. The three first applying portions 121 "bite" the sides of the object 20 so that the object 20 can be rotated.

The wrench of the present invention is able to tighten the object 20 by rotating the wrench clockwise, and to loosen the object 20 by rotating the wrench counter clockwise. When the object 20 is rotated counter clockwise, the sides of the object 20 are not damaged. When the object 20 is rounded, the three first applying portions 121 "bite" the three sides of the object 20 so s to rotate the object 20. Therefore, the wrench is able to rotate an object 20 regardless of the object 20 having a normal shape or being rounded.

While we have shown and described the embodiment in accordance with the present invention, it should be clear to those skilled in the art that further embodiments may be made without departing from the scope of the present invention.

What is claimed is:

1. A wrench comprising:

a body having a mounting hole defined therethrough, the mounting hole having three first driving portions and three second driving portions defined in an inner periphery thereof, the first driving portions located alternatively relative to the second driving portions, three first recesses and three second recesses defined in the inner periphery of the mounting hole, the first recesses located alternatively relative to the three second recesses, each first recess connected between one of the first driving portions and one of the second portions;

each first driving portion having a first applying portion which is a tip, a first face, a first curved face and a second face, the first applying portion located at a middle portion of the first driving portion corresponding thereto, the first applying portion connected between the first face and the first curved face, the first face being a plane or a protruded face, a tangent line passing through a connection point between an end of the first curved face and the first applying portion, an angle defined between the tangent line and the first face being between 100 degrees to 120 degrees, the other end of the first curved face connected to the second face, the second face being tangent to the second curved face, the fourth face being a plane or a protruded face;

each second driving portion having a second applying portion which is a tip, a third face, a second curved face and a fourth face, the second applying portion located at a middle portion of the second driving portion corresponding thereto, the second applying portion connected between the third face and the second curved face, the third face being a plane or a protruded face, the second curved face being tangent to the second applying portion, one end of the second curved face connected to the fourth face, the fourth face being tangent to the second curved face, the fourth face being a plane or a protruded face;

the first recess located between the second face and the fourth face, the first recess being tangent to the second face and the fourth face;

the second recess located between the first face and the third face, the second recess being not tangent to the first and third faces, and a center of the mounting hole being a center of a circle, the circle being externally tangent to a hexagon, each of the first applying portions located on a middle point of one of six sides of the hexagon, the second faces being respectively parallel to three of six sides of the hexagon, the fourth faces being parallel to the other three of the six sides of the hexagon, each of the second applying portions being tangent to one of the six sides of the hexagon, the second face and the fourth face being symmetric relative to a diagonal line that passes through two of six corners of the hexagon, the first face and the third face being symmetric relative to another diagonal line that passes through two of six corners of the hexagon, a center of each of the first recesses located on the diagonal line, a center of each of the second recesses located on the diagonal line, an angle between the first face and the side of the hexagon corresponding to the first face.

2. The wrench as claimed in claim 1, wherein the body is a box-end wrench, the mounting hole is defined through the body.

3. The wrench as claimed in claim 1, wherein an angle between the first face and the tangent line is 110 degrees.

4. The wrench as claimed in claim 1, wherein an angle between the first face and the side of the hexagon is 8 to 10 degrees.

5. The wrench as claimed in claim 1, wherein the body is a socket with a closed end, a socket with a passage defined axially through, a ratchet structure, a T-bar structure, an universal connector, or an open-end wrench.

6. The wrench as claimed in claim 1, wherein the first face of each of the first driving portions has multiple notches which are located along a straight line.

7. The wrench as claimed in claim 1, wherein the second applying portion of each of the second applying portions is a tip which is identical to the first applying portion, the first and second applying portions are symmetric relative to the diagonal line.

8. The wrench as claimed in claim 1, wherein the second recesses each are tangent to the first and third faces.

* * * * *